United States Patent [19]

Cordingley et al.

[11] 4,333,033

[45] Jun. 1, 1982

[54] ANODE CONTACT SPRING AND METHOD THEREOF FOR COLOR CATHODE RAY PICTURE TUBES

[75] Inventors: Lowell A. Cordingley, Des Plaines; Lester C. Gutschick, Deerfield, both of Ill.

[73] Assignee: Zenith Radio Corporation, Glenview, Ill.

[21] Appl. No.: 127,161

[22] Filed: Mar. 4, 1980

[51] Int. Cl.[3] ..... H01J 29/07

[52] U.S. Cl. ..... 313/407; 313/451; 313/477 HC

[58] Field of Search ..... 313/407, 406, 408, 451, 313/477 HC

[56] References Cited

U.S. PATENT DOCUMENTS

| | | | |
|---|---|---|---|
| 3,541,373 | 11/1970 | Barr | 313/85 |
| 3,931,541 | 1/1976 | Brenner | 313/407 |
| 4,230,965 | 10/1980 | Brenner | 313/407 |
| 4,243,908 | 1/1981 | Brenner | 313/407 |

FOREIGN PATENT DOCUMENTS

| | | |
|---|---|---|
| 48-12959 | 2/1973 | Japan . |
| 1503865 | 3/1978 | United Kingdom . |

*Primary Examiner*—Eli Lieberman
*Attorney, Agent, or Firm*—Ralph E. Clarke, Jr.

[57] ABSTRACT

An improvement in an anode contact spring for use in a color cathode ray tube is disclosed. The improvement comprises positive locking means for locking an attachment end of the contact spring to a supportive member for suspending the shadow mask adjacent to the panel. The positive locking means comprises bolt means extending from the supportive member and which is located in a preselected lateral position on the member. Clasping means on the attachment end provide for clasping the supportive member. One leg of the clasping means is a hasp for engaging the bolt. An anti-twistoff fold is provided in the contact spring adjacent to the attachment end. Upon engagement by manual pressure of the clasping means with a supportive member, the clasping means expands to provide engagement of the hasp with the bolt, then contracts to provide push-click positive locking of the contact spring to the supportive member. The anti-twistoff fold allows for substantial deflection of the contact spring without twisting off and unlocking the clasping means. The preselected locating of the bolt provides for the precise lateral positioning of the anode contact spring with respect to the shadow mask and the funnel.

9 Claims, 4 Drawing Figures

ANODE CONTACT SPRING AND METHOD THEREOF FOR COLOR CATHODE RAY PICTURE TUBES

BACKGROUND OF THE INVENTION AND PRIOR ART DISCLOSURES

This invention relates to color cathode ray picture tubes of the type having a shadow mask for color selection, and is particularly concerned with means and method for establishing the mask and imaging screen at the proper electrical potential.

The area enclosed by the funnel and face panel of a color cathode ray picture tube is typically established as a field-free region for the excursion of the electron beams that selectively excite the pattern of discrete phosphor targets deposited on the inner surface of the face panel that comprises the picture imaging screen. The field-free region is established by charging the inner surfaces of the funnel and face panel and adjacent components to a high potential, typically in the range of 25–32 kilovolts. The surfaces so charged include the conductive coating deposited on the inner surface of the funnel and an electrically conductive film, normally aluminum, disposed on the back of the picture imaging screen. The shadow mask is also charged to the same high potential. The shadow mask, which may have a frame, or be of the frameless type, is typically suspended adjacent to the face panel by a plurality of spring means attached at one end to a shadow mask supportive member such as the frame, and at the opposite end to an electrically conductive pin extending from the face panel flange, and in electrical contact with the imaging screen and its electrically conductive film. The electrically conductive coating on the inner surface of the funnel receives the high potential from a metallic "anode button" that protrudes through the wall of the funnel, and which in turn is connected to a conductor leading from a power supply.

The electrical path between the electrically charged funnel coating and the shadow mask and screen is typically supplied by means of an electrical bridge comprising a flexible spring, one end of which is commonly welded to the mask frame, and with a distal end spring-biased and suitably shaped to make contact with the electrically charged conductive coating on the funnel. This bridge is commonly termed an "anode contact spring."

The process by which the anode contact spring is attached to the shadow mask is usually by locating the spring by eye and fastening it by spot welding. This process has presented problems. For example, proper placement of the spring is operator-dependent, and an error in location can result in an installation in which the anode contact spring may make little or no contact with the funnel conductive coating. Also, "weld splash" consequent to the welding process can occlude one or more of the apertures of the nearby foraminated section of the mask. The occlusion of only one such aperture is clearly visible to the viewer. Further, if it is necessary to salvage the shadow mask, removal of the welded-on bridging means is difficult and its dislodgment can result in distortion and destruction of the mask.

Installation of the standard bridging spring on a shadow mask of the frameless type has also presented a problem. A mask of this type is disclosed in U.S. Pat. No. 4,100,451 to Palac, of common ownership herewith. The frameless mask comprises a low-cost, light weight, non-self-rigid, torsionally flexible mask preferably of one-piece construction. Because of the absence of a frame and the thinness of the mask material (of the order of six mils), a bridging means cannot be attached to the mask by conventional means. Attachment to the very thin metal of such a mask by welding for example would most likely result in a very light, inadequate pressure against the electrically charged inner surface because of mask flexing. Also, the mask itself could be deformed, and welding to the very thin metal of the mask is considered impractical.

In the application Ser. No. 584,566 filed June 4, 1975, now abandoned, of common ownership herewith described in British Patent Specification No. 1,503,865, an electrical bridge comprising an anode contact spring is disclosed for use with a color television picture tube having a flangeless faceplate and a shadow mask of the aforedescribed frameless type. At least one electrically conductive shadow mask support stud projects from the faceplate inner surface. The contact spring comprises a sleeve-like base for making slidable frictional engagement with the stud, and a spring member extends from the base for resiliently contacting the electrically charged funnel coating. The sleeve-like base may have a rectangular cross-sectional configuration substantially matching the cross-sectional configuration of the stud, but slightly larger to provide for outside telescoping engagement of the base with the stud. The base may be welded to the stud after such engagement.

Japanese Patent No. 48-12959/73 (JPC 99 F 120.2) discloses an electrically conductive contact spring affixed to an electrically conductive element. As best understood by examination of the drawing, it appears that the contact spring extends from a shadow-mask-supporting stud.

U.S. Pat. No. 3,541,373—Barr discloses an electrical bridge comprising a contact spring which is affixed to the frame of a shadow mask. The spring is shown as being formed with a clip portion which appears to snap over the edge of a flange of the frame and an associated electron beam shield. Although not shown, it is assumed that the attachment means is made more secure by an in-turning flange at the end of the spring to engage the turned-in rim of the shield. The security of the attachment is believed to be defeated by the fact that the force exerted by the distal end of the bridge against the funnel in making contact with the conductive coating is in the direction of the force required to unclip the spring. Additionally, the bridge would seem to be vulnerable to accidental dislodgement. It is believed that for this reason, an alternate and more secure method of attaching by welding is taught.

OBJECTS OF THE INVENTION

It is a general object of this invention to provide improved electrical bridging means for establishing certain internal components of color cathode ray picture tubes at a common electrical potential.

It is a less general object of the invention to provide for elimination of welding as a means of attaching an anode contact spring in relation to the shadow mask.

It is a more specific object of the invention to simplify the salvaging of shadow masks.

It is a specific object of the invention to provide means for installation of an anode contact spring having positive locking means according to the invention in relation to a non-self-rigid, torsionally flexible, frameless shadow mask.

BRIEF DESCRIPTION OF THE DRAWINGS

The features of the present invention which are believed to be novel are set forth with particularity in the appended claims. The invention, together with further objects and advantages thereof may best be understood by reference to the following description taken in conjunction with the accompanying drawings, in the several figures of which like reference numerals identify like elements, and in which:

DESCRIPTION OF THE PREFERRED EMBODIMENT

Figure 1:
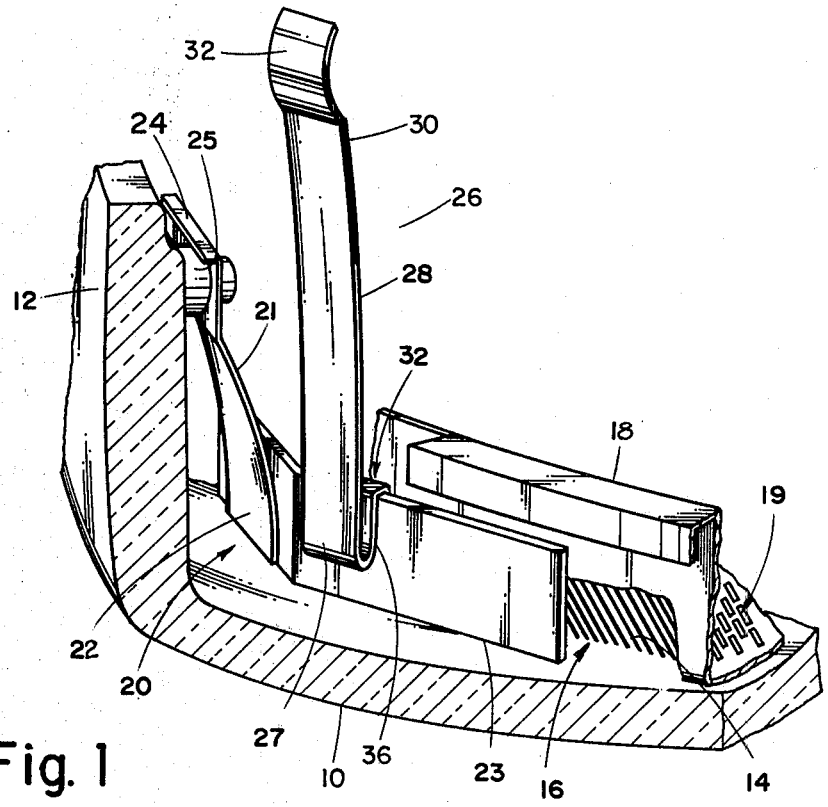
FIG. 1 is a sectional view in perspective of a fragment of a picture tube faceplate and a frameless shadow mask also partially in section, and equipped with anode contact spring attaching and locking means according to the invention.

FIG. 1 shows in perspective a view which will be readily recognized as a fragment of the glass envelope of a color cathode ray picture tube. A section of the face panel 10 is shown. The overall panel is substantially retangular with a flange 12 conjoined to a funnel (not shown) having an electrically conductive coating chargeable to a high potential on its inner surface.

Face panel 10 has an electron-excitable imaging screen 14 comprising triads of discrete phosphor targets in stripe form applied to an inner surface for selective activation by a plurality of electron beams. An electrically conductive coating 16 is indicated as being disposed on the back of the imaging screen 14. The picture tube further includes a non-self-rigid, torsionally flexible, frameless shadow mask 18. A pattern of foraminations 19 provides for color selection. Shadow mask 18 is suspended adjacent to screen 14 at the corners; one such mask corner 20 is depicted. The other three corners of mask 18 are substantially identical in the form and function of the mask suspension means. Each suspension means comprises a spring means 21 attached at an end 22 to bracket 23 embracingly fastened to corner 20 of mask 18. The opposite end 24 of leaf spring 21 is detachably engaged to an electrically conductive pin 25 extending from flange 12 and in electrical contact with imaging screen 14 and its associated electrically conductive coating 16. Electrical contact of pin 25 with electrically conductive coating 16 is ensured by means of a bridging application of a liquified solution (not shown) that hardens and becomes an electrical conductor when the tube is baked in a subsequent production process.

Anode contact spring 26 provides for electrical bridging between shadow mask 18 and the conductive coating of the funnel. Anode contact spring 26 has an attachment end 27 for attaching to bracket 23, a compliant intermediate section 28 and a distal end 30 for making electrical contact with the conductive coating on the funnel. Distal end 30 is shown by way of example as having a semi-spheric member 32 for making contact with the conductive coating of the funnel, which is otherwise electrically isolated from the shadow mask and associated imaging screen. More than one anode contact spring may be used, attached to any one of the other three brackets.

Figure 2:
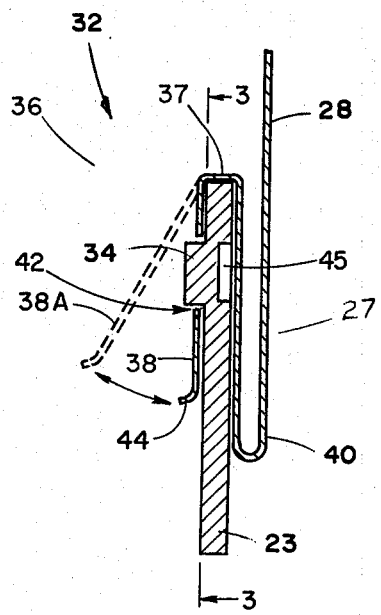
FIG. 2 is a detailed view in section and elevation depicting the engagement of the locking means according to the invention.
Figure 3:
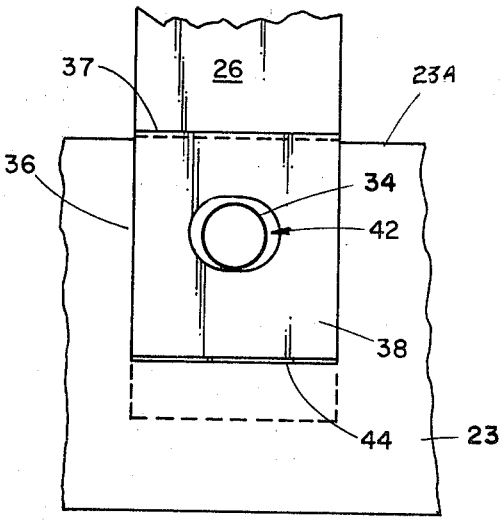
FIG. 3 is another view of the locking means according to the invention taken along lines 3—3 of FIG. 2; and, FIG. 4 is a view in perspective of an anode contact spring having locking means according to the invention, indicated as being attached to the frame of a shadow mask shown as a fragment.

The improvement according to the invention comprises positive locking means for locking attachment end 27 of anode contact spring 26 to a shadow mask support member, shown in this embodiment of the invention as being a bracket 23. Reference is now made to FIGS. 2 and 3 which depict in greater detail the preferred embodiment of the invention wherein the positive locking means 32 is shown as being attached and positively locked onto a shadow mask supportive member comprising bracket 23. Bolt means 34, located on a preselected position on bracket 23, extends from the bracket 23 by means as will be described infra. Clasping means 36 on attachment end 27 provide for clasping bracket 23. One leg of clasping means 36 is a hasp 38 for engaging bolt 34. An anti-twistoff fold 40 is provided in the intermediate section 28 of anode contact spring 26, and adjacent to attachment end 27. Upon engagement of clasping means 36 with the bracket 23 by manual pressure, wherein bolt 34 enters aperture 42 of hasp 38, clasping means 36 expands to provide engagement of hasp 38 with bolt 34, then contracts to provide push-click positive locking of anode contact spring 26 to bracket 23. The anti-twistoff fold 40, indicated in this embodiment of the invention as forming a double fold, allows for substantial deflection of anode contact spring 26 without twisting off and unlocking clasping means 36. Force in any direction exerted on anode contact spring 26, such as by accident contact during production assembly, merely tends to straighten the fold without unlocking the positive locking means according to the invention. The preselected locating of bolt 34 provides for precise lateral location of the anode contact spring 26 with respect to the shadow mask and the funnel. So precise location of the anode contact spring is not subject to human error.

The leg of clasping means 36 that comprises the hasp 38 is shown as having a foot 44 for facilitating the unlocking of clasping means 36. Foot 44 also provides for easy passage of hasp 38 over bolt 34 when clasping means 36 expands under manual pressure upon installation. Foot 44 also serves as a means for removal of the anode contact spring, as will be described.

Figure 4:
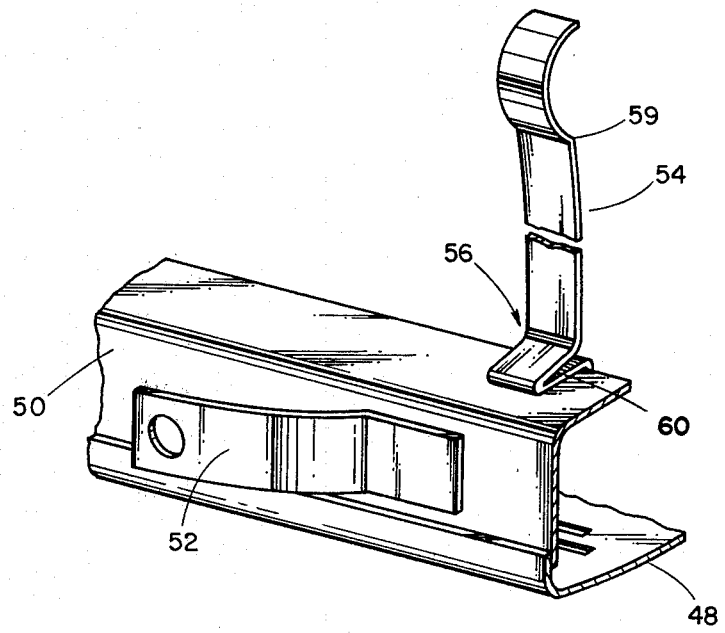

The positive locking means according to the invention is not limited in application to the frameless shadow mask depicted by FIG. 1, but is also applicable to shadow mask assembly of the type having an integral frame. FIG. 4 is a depiction of such a shadow mask assembly 48 in which the supportive member comprises a frame 50 which also provides rigidity to mask 48. A leaf spring 52 is indicated which is formed to suspend and space mask 42 adjacent to and in proper relationship to the picture imaging screen on the associated face panel (not shown). Anode contact spring 54 is shown as extending from frame 50 of shadow mask 48 to provide an electrical path between the electrically conductive coating on the panel and the mask and spring, the details of which have been described heretofore. The form and function of the positive locking means 56 is also as has been described heretofore in connection with positive locking means 32 shown by FIGS. 1–3. In this configuration of the anode contact spring designed for positive locking to a shadow mask frame, the anti-twistoff fold 56 provides an orientation of the distal end 59 which extends from the flexible clasping means 60 at an angle from frame 50 effective to provide contact of the distal end 59 of anode contact spring 54 with the electrically conductive funnel coating.

The method of providing positive locking means for attaching and locking an anode contact spring to a shadow mask having a supportive member comprises establishing a precise lateral location for the contact spring on the supportive member. The supportive member is shaped preferably by semi-perforating or "out-striking" at the desired location to form a bolt extending therefrom. An end of the anode contact spring is formed into flexible clasping means for clasping the supportive member at the desired location. A leg of the clasping means is formed as a hasp for engaging the bolt. The contact spring is folded adjacent to the clasping means to provide anti-twistoff capability. The clasping means is pushed over the supportive member at the desired location and the clasping means expands to provide engagement of the hasp with the bolt, then contracts to provide positive push-click locking of the contact spring to the supportive member.

The material of which the anode contact spring is comprised is preferably ANSI-type 304 full-hardness stainless steel having a thickness in the range of 5–7 mils. The desired configuration of the anode contact spring, including the formation of the clasping means and the anti-twistoff fold, can be provided by the multi-slide metal-forming machine well known in the art.

Positive electrical contact with the supportive member can be established by shear-forming the end 37 of clasping means 36. As a result, two small "ears" are formed which provide an interference fit in which the edges bite down into the supportive member, whether bracket or frame, to which the anode contact spring is attached and positively locked. The positive locking means can be unlocked, for example, by manually pulling hasp 38 into the configuration indicated by 38A, using foot 44. More expediently, a simple lever "key" can be devised for lifting hasp 38 away from engagement with associated bolt 34 by means of the foot 44.

The bolt 34 can be made to extend by "out-striking," or "semi-perforating;" that is, using a tool that punches a slug out of the parent metal to form the bolt. An effect of the semi-perforating process is indicated by the indentation 45 in bracket means 23 shown by FIG. 2. This and other means of forming the positive locking means according to the invention are well known in the art of metal working and need no detailed exposition.

The diameter of the bolt 40 is preferably about 0.109 inch, and it projects about 0.030 inch from the surface of the supportive member. The length of the hasp, for example, may be about 0.4 inch. The dimensions of the clasping means are dependent of course on the thickness of material to be clasped. For example, the thickness of a shadow mask frame is about 0.06 inch, and the flexible clasping means is preferably formed to fit this thickness snugly, as indicated graphically by FIG. 4. It is to be noted that all dimensions cited and depicted are by way of example only, and are in no way limiting.

It will be noted from FIG. 3 that aperture 42 is appreciably longer in the direction lateral to the edge 23A of bracket 23 than the diameter of bolt 34. This latitude is provided to allow easy and rapid location of the bolt 34 with respect to the aperture 42. Experience in engaging the anode contact spring has shown that manual attachment is quick and easy and the push-click locking according to the invention positive and sure. Unlocking and removal is easily and quickly accomplished.

Other changes may be made in the above-described apparatus and method without departing from the true spirit and scope of the invention involved. It is intended therefore that the subject matter of the foregoing depiction, including all dimensions and values, shall be interpreted as illustrative and not in a limiting sense.

We claim:

1. An anode contact spring for use in a color cathode ray tube having a glass envelope including a substantially rectangular face panel with a flange conjoined to a funnel having an electrically conductive coating chargeable to a high potential deposited on the inner surface thereof, said panel having an electron-excitable picture imaging screen applied to an inner surface thereof, and an electrically conductive coating disposed on the back of said screen, said tube further including a shadow mask having at least one supportive member for suspending said mask adjacent to said panel by spring means attached at one end to said supportive member, and at the opposite end to an electrically conductive pin extending from said flange and an electrical contact with said screen, said anode contact spring having an attachment end for attaching to said supportive member and a distal end for making contact with said conductive coating of said funnel, the improvement comprising positive locking means for locking said attachment end of said contact spring to said supportive member, the locking means comprising:

bolt means extending from said supportive member and located in a preselected position on said member;

clasping means on said attachment end for clasping said supportive member, one leg of said clasping means being a hasp for engaging said bolt;

an anti-twistoff fold in said contact spring and adjacent to said attachment end;

such that upon engagement by manual pressure of said clasping means with said supportive member, said clasping means expands to provide engagement of said hasp with said bolt, then contracts to provide push-click positive locking of said contact spring to said member, and such that said anti-twistoff fold allows for substantial deflection of said contact spring without twisting off and unlocking said clasping means, and the preselected locating of said bolt provides for the precise lateral positioning of said anode contact spring with respect to said shadow mask and said funnel.

2. An anode contact spring for use in a color cathode-ray picture tube having a glass envelope including a substantially rectangular face panel with a flange conjoined to a funnel having an electrically conductive coating chargeable to a high potential deposited on the inner surface thereof, said face panel having an electron-excitable picture imaging screen applied to an inner surface thereof and an electrically conductive coating disposed on the back of said screen, said tube further including a non-self-rigid, torsionally flexible, frameless shadow mask suspended adjacent to said screen at the corners by spring means attached at one end to brackets embracingly fastened to said corners, and at the opposite end detachably engaged to electrically conductive pins extending from said flange and in electrical contact with said screen, said anode contact spring providing for electrical bridging between said mask and said conductive coating of said funnel, said contact spring having an attachment end for attaching to said bracket, a compliant intermediate section, and a distal end for making electrical contact with said conductive coating on said funnel, the improvement comprising positive locking means for locking said attachment end of said contact spring to one of said brackets, comprising:

bolt means extending from said bracket and located in a preselected position on said bracket;

clasping means on said attachment end for clasping said bracket, one leg of said clasping means being a hasp for engaging said bolt;

an anti-twistoff fold in said intermediate section of said contact spring and adjacent to said attachment end;

such that upon engagement of said clasping means with said bracket by manual pressure, said clasping means expands to provide engagement of said hasp with said bolt, then contracts to provide push-click positive locking of said contact spring to said bracket, and such that said anti-twistoff fold allows for substantial deflection of said contact spring without twisting off and unlocking said clasping means, and the preselected locating of said bolt provides for the precise lateral location of said anode contact spring with respect to said bracket and said funnel.

3. The contact spring defined by claim 2 wherein said leg of said clasping means has a foot for facilitating of unlocking of said clasping means.

4. An anode contact spring for use in a color cathode-ray picture tube having a glass envelope including a substantially rectangular face panel with a flange conjoined to a funnel having an electrically conductive coating chargeable to a high potential deposited on the inner surface thereof, said face panel having an electron-excitable imaging screen applied to an inner surface thereof and an electrically conductive coating disposed on the back of said screen, said tube further including a shadow mask and frame assembly suspended adjacent to said screen by spring means attached at one end to said frame, and at the opposite end to electrically conductive pins extending from said flange and in electrical contact with said screen, said anode contact spring providing for electrical bridging between said mask and said conductive coating of said funnel, said contact spring having an attachment end for attaching said spring to said frame, a compliant intermediate section, and a distal end for making electrical contact with said conductive coating on said funnel, the improvement comprising positive locking means for locking said attachment end to said frame, the positive locking means comprising:

bolt means extending from said frame and located in a preselected position on said bracket;

clasping means on said attachment end of said contact spring for clasping said frame, one leg of said clasping means being a hasp for engaging said bolt;

an anti-twistoff fold in said intermediate section and adjacent to said attachment end;

such that upon engagement by manual pressure of said clasping means with said bracket, said clasping means expands to provide engagement of said hasp with said bolt, then contracts to provide push-click positive locking of said contact spring to said frame, and such that said anti-twistoff fold allows for substantial deflection of said contact spring without twisting off and unlocking said clasping means, and the preselected locating of said bolt provides for the precise lateral positioning of said anode contact spring with respect to said frame and said funnel.

5. The contact spring defined by claim 4 wherein said leg of said hasp has a foot for facilitating unlocking of said clasping means.

6. For use in the manufacture of television cathode-ray picture tubes, a method of precisely locating and positively locking an anode contact spring to a shadow mask assembly having a contact spring supportive member, comprising:

establishing a precise lateral location for said contact spring on said supportive member;

shaping said supportive member at said desired location to form a bolt extending therefrom;

forming an end of said contact spring into flexible clasping means for clasping said supportive member at said desired location;

forming a leg of said clasping means as a hasp for engaging said bolt;

folding said spring adjacent to said clasping means to provide anti-twistoff capability;

pushing said to clasping means over said supportive member at said location;

such that said clasping means expands to provide engagement of said hasp with said bolt, then contracts to provide positive push-click locking of said contact spring to said supportive member, and such that said anti-twistoff fold allows for substantial deflection of said contact spring without twisting off and unlocking said clasping means, and the preselected locating of said bolt provides for the precise lateral positioning of said anode contact spring with respect to said supportive member and said funnel.

7. The method defined by claim 6 wherein said supportive member to which said contact spring is locked comprises a bracket embracingly fastened to a corner of a substantially rectangular, non-self-rigid, torsionally flexible frameless shadow mask.

8. The method defined by claim 6 wherein said supportive member comprises the frame of a shadow mask assembly of the type having an integral frame.

9. The method defined by claim 6 wherein said leg of said hasp has a foot for facilitating unlocking of said clasping means.

* * * * *